US012075879B2

(12) United States Patent
Boerma

(10) Patent No.: US 12,075,879 B2
(45) Date of Patent: Sep. 3, 2024

(54) SHOE SOLE ASSEMBLY, SHOE, AND METHOD OF MANUFACTURING A SHOE

(71) Applicant: ANBO AMERSFOORT B.V., Leusden (NL)

(72) Inventor: Antonius Bernardus Boerma, Leusden (NL)

(73) Assignee: ANBO AMERSFOORT B.V., Leusden (NL)

( * ) Notice: Subject to any disclaimer, the term of this patent is extended or adjusted under 35 U.S.C. 154(b) by 320 days.

(21) Appl. No.: 17/610,228

(22) PCT Filed: May 14, 2020

(86) PCT No.: PCT/NL2020/050306
§ 371 (c)(1),
(2) Date: Nov. 10, 2021

(87) PCT Pub. No.: WO2020/231259
PCT Pub. Date: Nov. 19, 2020

(65) Prior Publication Data

US 2022/0330654 A1 Oct. 20, 2022

(30) Foreign Application Priority Data

May 15, 2019 (NL) ..... 2023135

(51) Int. Cl.
*A43B 13/12* (2006.01)
*A43B 13/18* (2006.01)
*A43D 86/00* (2006.01)

(52) U.S. Cl.
CPC ..... *A43B 13/18* (2013.01); *A43B 13/12* (2013.01); *A43B 13/122* (2013.01); *A43D 86/00* (2013.01)

(58) Field of Classification Search
CPC ..... A43B 13/12; A43B 13/122; A43B 13/125; A43B 13/14; A43B 21/24; A43B 13/16; A43B 13/34; A43B 23/22
(Continued)

(56) References Cited

U.S. PATENT DOCUMENTS 1,602,637 A * 10/1926 Barva ..... A43B 21/24 36/35 R
2,025,647 A * 12/1935 Daly ..... A43B 13/34 36/35 R (Continued)

FOREIGN PATENT DOCUMENTS

EP 1308103 A2 5/2003
WO 2006127427 A2 11/2006

OTHER PUBLICATIONS

International Search Report and Written Opinion for PCT/NL2020/050306, mailed Sep. 15, 2020, eleven (11) pages.

*Primary Examiner* — Marie D Bays
(74) *Attorney, Agent, or Firm* — KDW Firm PLLC

(57) ABSTRACT

A shoe sole assembly having a hindfoot section and a forefoot section including an inner sole having a shock absorbing material, a load-bearing outer sole configured to receive the inner sole, and a heel piece including a recess configured to receive at least part of the hindfoot section of the load-bearing outer sole. The recess is upwardly open and open towards the forefoot section. A shoe includes an upper and the shoe sole assembly. A method of manufacturing a shoe includes the steps of forming the load-bearing outer sole based on a lower side of a last, fastening part of the hindfoot section of the load-bearing outer sole to the heel piece, which has a recess which is upwardly open and open towards the forefoot section, and fastening the upper to the upper surface of the load-bearing outer sole.

14 Claims, 2 Drawing Sheets

(58) Field of Classification Search
USPC ..... 36/31, 107, 30 R, 35 R
See application file for complete search history.

(56) References Cited

U.S. PATENT DOCUMENTS

| | | | | | |
|---|---|---|---|---|---|
| 3,903,622 | A * | 9/1975 | Penalver | A43B 23/22 | 36/76 R |
| 5,416,989 | A * | 5/1995 | Preston | A43B 21/38 | 36/76 R |
| 5,832,634 | A * | 11/1998 | Wong | A43B 13/187 | 36/31 |
| 5,918,338 | A * | 7/1999 | Wong | A43B 13/16 | 12/146 S |
| 6,212,795 | B1 * | 4/2001 | Nakabe | A43B 7/18 | 36/76 R |
| 6,233,846 | B1 * | 5/2001 | Sordi | A43B 5/12 | 36/105 |
| 6,418,641 | B1 * | 7/2002 | Schenkel | A43B 13/12 | 36/102 |
| 6,968,637 | B1 * | 11/2005 | Johnson | A43B 3/0063 | 36/108 |
| 7,401,422 | B1 * | 7/2008 | Scholz | A43B 13/12 | 36/102 |
| 2002/0017036 | A1 * | 2/2002 | Berger | A43B 13/186 | 36/31 |
| 2005/0108898 | A1 * | 5/2005 | Jeppesen | A43B 9/02 | 36/30 R |
| 2006/0137228 | A1 | 6/2006 | Kubo et al. | | |
| 2007/0017122 | A1 * | 1/2007 | Feller | A43B 7/1445 | 36/76 R |
| 2009/0193682 | A1 | 8/2009 | Rosenbaum | | |
| 2013/0074364 | A1 | 3/2013 | Lim | | |
| 2017/0079379 | A1 * | 3/2017 | Singh | A43B 7/1445 | |
| 2017/0202301 | A1 * | 7/2017 | Amis | A43B 5/02 | |
| 2019/0380434 | A1 * | 12/2019 | Luh | B32B 9/047 | |
| 2019/0380437 | A1 * | 12/2019 | Luh | A43B 13/16 | |
| 2021/0169170 | A1 * | 6/2021 | Fahmi | A43B 21/28 | |
| 2021/0259367 | A1 * | 8/2021 | Ekstrom | A43B 13/122 | |

* cited by examiner

SHOE SOLE ASSEMBLY, SHOE, AND METHOD OF MANUFACTURING A SHOE

This application is a national stage filing under 35 U.S.C. 371 of pending International Application No. PCT/NL2020/050306, filed May 14, 2020, which claims priority to Netherlands Patent Application No. NL 2023135, filed May 15, 2019, the entirety of which is incorporated by reference herein.

The present invention relates to a shoe sole assembly, in particular for dress shoes, and a shoe comprising an upper and a shoe sole assembly.

The traditional dress shoe usually comprises a firm inner sole with a shank, such as a resilient metal element, which prevents bending, i.e. sagging, of the shoe along a longitudinal axis thereof. During manufacturing of the dress shoe, the inner sole with the shank is placed under a last, after which the upper, which in the case of a dress shoe is usually made of a type of leather, is fixed to the inner sole by using a lasting machine. A sole assembly of a traditional dress shoe is therefore comprised of a multitude of layers, in particular leather layers, such as an insole, the inner sole, the shank, one or multiple midsoles, an outsole, and so on.

As a dress shoe traditionally requires a multitude of layers whilst still providing a slender exterior appearance, as desired by the user, such shoe lacks significant damping, i.e. shock absorbance. Therefore, traditional dress shoes are widely considered to be uncomfortable for the user's feet and body if worn for prolonged periods of time. Namely, shocks generated by walking on the traditional dress shoes are barely absorbed, and propagate almost directly into the foot, ankles, knees, and rest of the body of the user. Therefore, many users experience physical discomfort when wearing such shoes, including sore feet, strained ankles and knees, back pains, and so on.

It is an object of the invention, amongst others, to provide a shoe sole, in particular for dress shoes, which is significantly more comfortable for the user, i.e. extenuates physical discomfort for the user, whilst still allowing for a slender exterior appearance of the shoe, i.e. whilst retaining the traditional exterior appearance of such shoe, in particular a dress shoe. In other words, it is an object of the invention to mitigate the abovementioned drawbacks of the prior art.

According to the invention there is provided a shoe sole assembly is having a hindfoot section and a forefoot section, comprising an inner sole, comprising a shock absorbing material, a load-bearing outer sole configured to receive the inner sole, and a heel piece, comprising a recess configured to receive at least part of the hindfoot section of the load-bearing outer sole, which recess is upwardly open and open towards the forefoot section. In other words, the load-bearing outer sole has an exterior surface and an interior surface, wherein the interior surface is configured to receive the inner sole, and the heel piece has a lower surface, which contacts the ground when the shoe sole is being walked on, and an upper surface, wherein the upper surface comprises a recess configured to receive at least part of the hindfoot section of the exterior surface of the load-bearing outer sole and which recess is open in a direction away from the lower surface and in a direction from the hindfoot section to the forefoot section of the shoe sole assembly. The load-bearing outer sole provides the required structural strength and stiffness of the shoe sole, and hence replaces at least the traditional inner sole, shank, one or multiple midsoles, and the outsole. Therefore, the thickness of the sole assembly as a whole is greatly reduced as compared to a traditional shoe sole.

Furthermore, due to the recess in the heel piece of the sole assembly, a significant additional volume is provided, which allows for a thicker inner sole, i.e. more shock absorbing material, especially at the hindfoot part of the sole assembly where the force of the shocks generated by walking are mostly concentrated. Hence, a shoe sole assembly is provided which comprises a greater amount of shock absorbance, i.e. damping, without increasing the outer dimensions of the shoe sole assembly, and therefore a shoe comprising such shoe sole assembly. For instance, a dress shoe having a traditional exterior appearance can be provided with significantly more shock absorbent material by usage of a shoe sole assembly according to the present invention. Preferably, the load-bearing outer sole is locally flexible, e.g. weakened, between the forefoot section and the hindfoot section, such that the outer sole may bend in accordance with the user's foot during walking. It is to be noted that the load-bearing outer sole is an outermost sole of the shoe sole assembly, not to be confused with a traditional strengthening element such as a shank which resides between layers of a shoe sole assembly. Further, it is to be noted that the the outer sole being "load-bearing" is to be construed as the outer sole being the main structural element of the shoe sole assembly, providing the shoe sole assembly with a required rigidity, a required resilience, a required flexibility, a required strength, et cetera. In other words, the term "load-bearing" is not to be construed merely as the outer sole being configured to bear an arbitrary load. The load-bearing outer sole may be a monocoque structure, i.e. a structural 'skin', being a structural element wherein loads exerted on the shoe sole assembly are supported through the external skin, in this case the load-bearing outer(most) sole, similar to an egg shell. Accordingly, the load-bearing outer sole of the shoe sole assembly according to the present invention does not require a shank, or other strengthening element, in order to maintain its shape or bear the load of a person standing on the shoe sole assembly.

Preferably, the outer sole is at least partially arched in longitudinal directions, e.g. not planar. More preferably, the outer sole is arched such that an exterior surface thereof contacts the heel piece at part of the hindfoot section and the ground and/or a forefoot piece at at part of the forefoot section. Accordingly, part of the exterior surface of the outer sole does not make contact with a further element or the ground. In other words, the outer sole bridges a gap between the shoe sole assembly and a surface whereon the shoe sole assembly is placed. The outer sole may have several arching sections, not necessarily arching to the same extend or in the same direction, e.g. both upward and downward arching directions.

In a preferred embodiment of the shoe sole assembly, the shoe sole assembly comprises a forefoot piece, comprising a forefoot recess configured to receive at least part of the forefoot section of the load-bearing outer sole, which recess is upwardly open and open towards the hindfoot section. Due to the recess in the forefoot piece of the sole assembly, a significant additional volume is provided therein, which allows for a thicker inner sole, i.e. more shock absorbing material. A recessed forefoot piece in addition to the recessed heel piece further improves the walking comfort for a user of the shoe sole assembly.

In a preferred embodiment of the shoe sole assembly, the load-bearing outer sole consists of a plastic, a fiber reinforced plastic, an aramid reinforced plastic, a carbon fiber reinforced plastic, a metal reinforced plastic, a metal, wood, or combinations thereof. Specifically, the load-bearing outer sole is preferably made of a fiber reinforced plastic, and more specifically made of carbon reinforced plastic. Specifically, the load-bearing outer sole is preferably made of an aramid reinforced plastic, and more specifically made of Kevlar, Nomex and/or Technora reinforced plastic. Said plastic may be any suitable polymer, for instance a synthetic or semi-synthetic organic compound, known to a person skilled in the art. As the load-bearing outer sole is the main structural part of the shoe sole assembly according to the invention, the material is preferably chosen such that the outer sole has the required stiffness, such that substantially no sagging of the shoe sole assembly occurs. In other words, the outer sole is manufactured such that the shank of a traditional dress shoe is effectively replaced therewith. For completeness' sake, as mentioned above, the traditional shank is usually a piece of metal inserted between the sole and the insole, lying against the arch of the foot. When using a fiber reinforced material, the fibers between the forefoot section and the hindfoot section are preferably only applied in longitudinal direction of the shoe sole assembly, so as to increase flexibility of the sole therebetween.

In a preferred embodiment of the shoe sole assembly, the load-bearing outer sole is coated with a metal, a plastic, a fabric, a mineral, a mineral crystal, an organic material, a lacquer, a varnish, or combinations thereof. Such coating may affect the structural properties of the outer sole. For instance, coating the outer sole with a metal or plastic might increase the durability of the outer sole, or its stiffness. Furthermore, such coating of the outer shoe may be chosen so as to alter the appearance/attractiveness of the shoe. Namely, the underside or outer sides of the outer sole may be visible when wearing a shoe comprising said outer sole. Therefore, the appearance thereof may be altered to suit the wishes of the user.

In a preferred embodiment of the shoe sole assembly, the recess is substantially concave. Firstly, a concave recess is preferred over, for instance, a rectangular recess, as the outer walls of the recess, i.e. the wall following the outer contour of the shoe sole assembly, may require a certain thickness in order to maintain structural rigidity of the heel piece. Secondly, the contour of the bottom of a human foot is substantially convex. Therefore, a concave recess in the heel piece, which may match a convex lower surface of the outer sole, allows the inner sole to comfortably deform so as to accommodate the natural shape of a human foot.

In a preferred embodiment of the shoe sole assembly, the load-bearing outer sole comprises a raised edge along its circumference. Firstly, such raised edge prevents movement of the inner sole when placed on the outer sole. Secondly, the raised edge along the entire circumference of the outer sole increases the stiffness of the outer sole, both in longitudinal and transverse direction of the sole. Thirdly, the raised edge may be configured so as to substantially follow the contour of the recess, such that the contact surface between the outer sole and the heel piece is increased, which may increase the strength of the bond between the outer sole and the heel piece when an adhesive is applied to said contact surface.

In a preferred embodiment of the shoe sole assembly, a thickness of the inner sole substantially corresponds to the depth of the recess. In other words, the inner sole substantially fills the recess of the heel piece. This allows for a significant amount of damping, i.e. shock absorbing, material as compared to a traditional dress shoe, which does not comprise a recessed heel piece. In other words, the recessed heel piece provides additional volume as compared to the traditional shoe, such that the additional volume may contain shock absorbing material, which increased comfort and alleviates physical discomfort for the user of the shoe sole assembly. Preferably, the load-bearing outer sole is as thin as possible whilst still providing the required structural properties, such that the majority of the volume made available according to the invention may be utilized for additional shock absorbing material. Preferably, when the outer sole is arched in longitudinal direction, e.g. partially bent about a lateral axis, the inner sole is configured such that its upper surface, i.e. its surface facing away from the outer sole, is substantially planar. Accordingly, a substantially flat walking surface is achieved, with maximum dampening, as the space between the upper surface of the inner sole and the inner surface of the outer sole, i.e. the surface facing the inner sole, is efficiently filled with the dampening, i.e. shock absorbing, material of the inner sole. Alternatively, the upper surface of the inner sole may be arched slightly to accommodate the natural arch of the human foot. In conclusion, the load bearing outer sole eliminates the need for additional strengthening elements commonly found in the shoe sole assemblies according to the prior art, such as a shank, and in addition the recess in the heel piece creates additional volume, such that additional volume, i.e. space, is created for dampening materials, embodied by the inner sole. The created additional volume substantially fully benefits dampening, i.e. shock absorbing, properties of the shoe sole assembly. This is achieved without any substantial enlargement of outer dimensions of the shoe sole assembly, which enlargement is for instance highly undesired for traditional dress shoes, which require a sleek and slender appearance. Accordingly, comfort for the user of the shoe sole assembly is improved without significantly altering the exterior appearance of the shoe sole assembly according to the prior art.

In a preferred embodiment of the shoe sole assembly, the load-bearing outer sole comprises a separate load-bearing hindfoot outer sole and a separate load-bearing forefoot outer sole, so as to allow bending of the shoe sole assembly between the hindfoot part and the forefoot part. Preferably, the load-bearing hindfoot outer sole and the load-bearing forefoot outer sole are connected by means of a flexible material, such as rubber. The flexible material is preferably a unidirectional fiber reinforced plastic, such as unidirectional carbon fiber reinforced plastic, i.e. a plastic reinforced by non-woven fibers, i.e. fibers running in a single, parallel direction. The load-bearing outer sole may be comprised of a material with high stiffness properties, which allows for a durable and safe shoe sole assembly construction. However, the shoe sole assembly may be required to bend at a certain position along the longitudinal direction thereof, for instance at the portion where the joints between the toes and the remainder of the foot of a user are placed during use. Therefore, the load-bearing outer sole may be divided into two parts, being a forefoot part and a hind/midfoot part, such that additional bending is allowed therebetween. The two separate outer sole parts may be joined using a flexible material, such as rubber, a fabric, or another suitable flexible material known to the skilled person. The two separate outer sole parts may also be attached to the inner sole, such that the inner sole forms the flexible material connecting said separate outer sole parts. In this case the outer sole parts are preferably attached to the inner sole by means of an adhesive, such as a natural or synthetic resin.

In a preferred embodiment of the shoe sole assembly, the heel piece and/or the forefoot section of the load-bearing outer sole comprise a wear-resistant bottom sole on the underside thereof. Preferably, the wear-resistant bottom sole comprises leather, rubber, plastic, wood, natural fibers, synthetic fibers, or combinations thereof. As the outer sole may be comprised of a plastic, or reinforced plastic, the structural properties thereof could diminish due to wear when the outer sole directly contacts the ground during use. The same holds for the heel piece, which may be comprised of wood, plastic, metal, or the like. Hence, it is preferred to cover the parts of the outer sole and/or heel piece with a wear-resistant material, specifically at the areas that contact the ground during use, i.e. when the user walks on the shoe sole assembly. Furthermore, the wear-resistant material is preferably a high-friction material, so as to allow for increased friction between the underside of the shoe sole assembly and slippery surfaces, such as polished marble or ceramic floors or the like. In further addition, the wear-resistant material is preferably profiled at the underside thereof, so as to allow for additional grip in environments with a substantially loose flooring material, such as snow, ice, leaves, branches, dirt, stones, combinations thereof, or the like.

According to a second aspect of the invention, there is provided a shoe, comprising an upper and a shoe sole assembly according to the invention, wherein the upper is attached to the shoe sole assembly. Preferably, the upper is attached to the shoe sole assembly by means of an adhesive, such as a natural or synthetic resin. More preferably, the upper is attached to the upper surface of the load-bearing outer sole, such that the inner sole resides within the upper. The 'upper' is defined as the entire part of the shoe that covers the foot, and in the case of a dress shoe is usually made up of a leather. However, the upper can be composed of a variety of materials, such as plastics, fabrics, rubber, artificial leather, such as polyurethane or vinyl coatings applied to a cloth backing, and the like, as well as combinations thereof. The upper can also comprise buckles, ornaments, shoe laces, hook-and-loop fasteners (e.g. Velcro), various decorations, and the like. In particular, the shoe is a dress shoe, either for males or females, as generally used in a formal social environment, such as a gala dinner or red carpet event. Accordingly, the load-bearing outer sole may be curved along its longitudinal axis in a broad S-shape, as seen from the side, to allow for a higher heel piece, as is customary for dress shoes for females.

In a preferred embodiment of the shoe, the load-bearing outer sole extends over at least a portion of the upper. This extension may have decorative, functional, or structural purpose. For instance, the outer sole may be extended over the nose of the shoe so as to protect the user's feet from falling object or the like, i.e. serving a structural purpose. For example, the outer sole may be extended over the upper in a certain pattern, so as to serve a decorative purpose. Further, thin elongate strips may for instance extend from the outer sole to the traditional shoe lace location on the upper, so as to form clamping means which may replace the traditional shoe lace, i.e. the thin elongate strips may be resilient so as to allow the user to insert his or her feet in the shoe after which the strips exert sufficient force to retain the shoe on the user's foot. In other words, the outer sole may extend over the upper to serve a functional purpose. For instance, a buckle or 'monk strap' may be formed by extending the outer sole, so as to form fastening means for the shoe.

According to the invention, additional space, i.e. volume, is created in a shoe, in particular a dress shoe, such that additional dampening, i.e. shock absorbing, material may be provided in the shoe whilst retaining the traditional appearance of the shoe. Firstly, by reducing the number of layers as compared to a traditional shoe by utilization of the load-bearing outer sole according to the invention, and secondly, by partially hollowing the heel piece of the shoe.

According to a third aspect of the invention, there is provided a method of manufacturing a shoe according to the invention, comprising the steps of:

- forming the load-bearing outer sole based on a lower side of a last
- fastening part of the hindfoot section of the load-bearing outer sole to the heel piece, which has a recess which is upwardly open and open towards the forefoot section, and
- fastening the upper to the upper surface of the load-bearing outer sole.

In a general shoe manufacturing process, the upper of the shoe is usually formed on the basis of a last. A last is a mechanical form, usually out of wood, metal, plastic or the like, which is shaped in accordance to a human foot with a certain shoe size. Traditionally, a shoe sole assembly is cut, or otherwise formed, separate from the last, after which the sole is placed under the last and the upper is subsequently fastened to the sole by means of a lasting machine, as explained above.

According to the invention, a last is provided which is deepened in accordance with the additional volume required for the inner sole having the shock absorbing material. The load-bearing outer sole is preferably made of a fiber reinforced plastic, which may be formed by laying up the fibers, which are preferably impregnated with a resin or the like, on the lower side of the last, i.e. the mold, after which further material may optionally be added, and finally the material is cured upon the last, or elsewhere if required. The curing process may entail applying pressure and/or heat to the laid up material and/or the last, i.e. the mold.

Preferably, the method further comprises the step of placing or fastening the inner sole to the upper. The inner sole may also be placed or fastened directly onto the load-bearing outer sole, for instance in the case when the upper has an open bottom side.

It is further preferred that at least one of the fastening steps of the method comprises fastening by means of an adhesive, such as a natural or synthetic resin. In other words, at least one of the fastening steps may comprise fastening by means of gluing. Namely, the hindfoot section of the load-bearing outer sole may be glued to the heel piece, the upper may be glued to the upper surface of the load-bearing outer sole, and the inner sole may be glued to the upper. Naturally, other means of fastening may be envisioned, such as nailing, clamping, heat-sealing (e.g. welding), or other fastening methods known to the skilled person.

The method according to the invention allows for decentralized production of shoes. Due to the relative ease of manufacturing, and the relatively low cost of the required tools for, for instance, laying up fiber reinforced plastic upon a last, i.e. mold, the fabrication process of a shoe sole assembly and a shoe according to the invention can take place virtually anywhere and on any scale (with regard to batch size). For instance, large machinery is not required for the manufacturing process. The manufacturing process can also easily be scaled up to allow for production of large batches. The manufacturing method according to the invention also allows for rapid prototyping of shoes, which entails relatively small batches. For instance, fashion houses regularly produce one-off, i.e. exclusive or unique, shoes for display in a fashion show. The shoe sole assembly and the accompanying method of manufacturing allow for different one-off uppers to be fastened to the same type of shoe sole assembly according to the invention. Accordingly, manufacturing costs are greatly reduced, as the manufacturing process may be performed in-house in small batches, in contrast to the expensive outsourcing of the manufacturing of one-off shoes. This further enables 'just-in-time' delivery, as small batches of shoes can be produced in a short amount of time at locations distributed across territories.

A traditional assembled shoe takes up a significant amount of volume during shipping, as the upper must retain its shape, i.e. the shape of a human foot, during shipping. According to the invention, the uppers may be shipped flat as an intermediate good, after which they are locally fastened and shaped to a locally produced shoe sole assembly according to the invention, using the manufacturing method according to the invention. The materials required for the manufacturing method are widely available worldwide, which may therefore be sourced locally as well. Hence, shipping costs, and the associated CO2-emissions, of shoes can be greatly reduced by making use of the invention.

The present invention is further elucidated below with reference to the figures.

Figure 1:
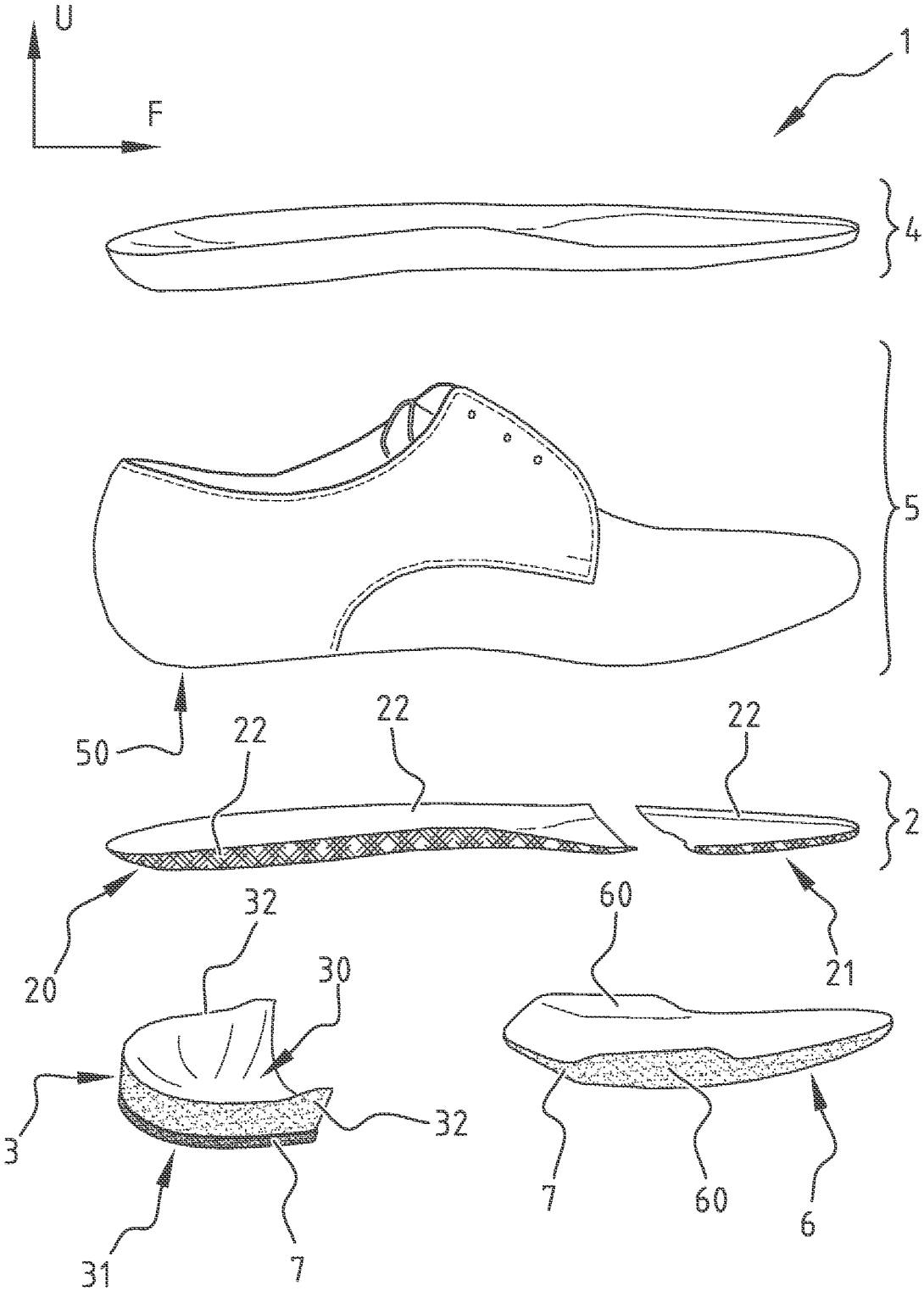
FIG. 1 shows an exploded view of an embodiment of a shoe.

FIG. 1 shows an exploded view of a shoe 1, comprising a load-bearing outer sole 2, a heel piece 3, an inner sole 4, an upper 5, and a forefoot piece 6. In the shown embodiment the outer sole 2 is comprised of a hindfoot outer sole 20 (also referred to as hindfoot part), and a forefoot outer sole 21 (also referred to as forefoot part), which are preferably made of carbon fiber reinforced plastic (CFRP).

The outer sole 2 is configured to receive the upper 5, and is therefore shaped according to the bottom surface 50 of the upper 5. The outer sole 2 further comprises a raised edge 22 along its outer circumference, which increases the stiffness of the outer sole 2 and in addition provides a larger contact surface between the upper 5 and the outer sole 2, such that a strong bond is formed therebetween by means of an adhesive. In further addition, the upper 5 is easily positioned on the outer sole 2 as the raised edge thereof 22 guides the upper 5 in the correct position during placement. The raised edge 22 is only interrupted between the hindfoot part 20 and the forefoot part 21 of the outer sole 2. In order to join the hindfoot 20 and forefoot 21 parts, a forefoot piece 6 is provided. In the shown embodiment the forefoot piece 6 is configured to be somewhat flexible, such that the sole assembly (2, 3, 4) is able to bend between the hindfoot part 20 and the forefoot part 21 of the outer sole 2. Namely, this location roughly corresponds to the location of the joints of the toes of a user wearing the shoe 1, such that a natural walking movement is allowed. A further advantage of the load-bearing outer sole 2 is that it effectively retains the shape of the nose portion, i.e. the forefoot portion, of the shoe 1.

The forefoot piece 6 comprises two ridges 60 extending upwardly from opposing sides of the forefoot piece 6. These ridges 60 allow, for instance, the correct positioning of the forefoot part 21 of the outer sole 2 thereon. In addition, the ridges 60 cover the transition portion between the hindfoot part 20 and the forefoot part 21 of the outer sole 2, such that the outer sole 2 has the appearance of being formed as a solid one-piece monocoque structure. The forefoot piece 6 is made of a flexible wear-resistant material 7, such as rubber, so as to allow bending between the hindfoot part 20 and the forefoot part 21. Furthermore, materials such as rubber provide grip, i.e. high friction, between the underside of the shoe 1 and the surface on which the shoe 1 is being used. In addition, as the flexible material is wear-resistant, the shoe 1, and in particular the outer sole 2, is also durable, as the outer sole 2 does not directly contact the ground whilst walking, which would scratch, abrade, or otherwise damage the outer sole 2. It is noted that the forefoot piece 6 may consist fully of the flexible wear-resistant material 7, or may be comprised of a wear-resistant material 7 on its underside and another flexible material on top of the wear-resistant material 7. Furthermore, the forefoot piece 6 may comprise a concave recess so as to allow for additional shock absorbing material in the inner sole 4.

With reference to FIG. 1 an embodiment of the heel piece 3 is herewith described in detail. The shown heel piece 3 comprises a substantially flat bottom surface 31, which is covered with a wear-resistant material 7, such as rubber or a plastic or the like. It is noted that the bottom surface 31 may also be partially covered in the wear-resistant material 7 or may not comprise wear-resistant material 7 at all. During use of the shoe 1, the bottom surface 31 contacts the floor on which the user walks, and is therefore most susceptible to wear. Furthermore, the heel piece 3 comprises a concave recess 30, which is configured to receive part of the hindfoot part 20 of the outer sole 2. The recess 30 is open in an upward direction U and toward the forefoot section direction F of the shoe 1. In contrast to a traditional dress shoe, the heel piece 3 comprising the recess 30 provides a bigger volume beneath the user's foot, so as to accommodate a thicker inner sole 4 as compared to the traditional shoe. However, the heel piece 3 retains the exterior appearance of the traditional heel piece due to the raised wall 32 along the outer contour of the upper 5, i.e. the recess 30 is not visible. Therefore, the traditional dress shoe appearance is maintained whilst providing additional volume for shock absorbing material by means of a thicker inner sole 4 comprising said material.

The concave shape of the recess 30 of the heel piece 3 ensures structural stiffness of the raised wall 32 and approximately follows the convex contour of the bottom side of a human foot's heel (not shown). Therefore, as the inner sole 4 is compressed by the weight and walking movement of a person, it is compressed into a concave recess 30 and therefore distributes the weight of the person along the entire heel of the person. Therefore, the shocks and pressure experienced by the user during walking are not concentrated on a small area of the foot of the user, which may cause discomfort, but are distributed over a larger area, i.e. the experienced pressure on heel of the foot is decreased. The inner sole 4 extends over the entire length and width of the outer sole 2, but has its greatest thickness above the heel piece 3. The recess 30 of the heel piece 3 accommodates the greater thickness and the majority of the pressure whilst walking in a normal fashion is generally concentrated at the heel portion of the user's foot. Hence, physical discomfort of the user of the shoe 1 is effectively mitigated. The concave shape of the recess 30 also closely follows the contour of the part of the hindfoot part 20 of the outer sole 2 which it receives when mounting the outer sole 2 to the heel piece 3, such that as large as possible contact surface between the heel piece 3 and the outer sole 2 is created. A large contact surface increases the strength of the bond, especially when an adhesive is utilized for mounting.

Figure 2:
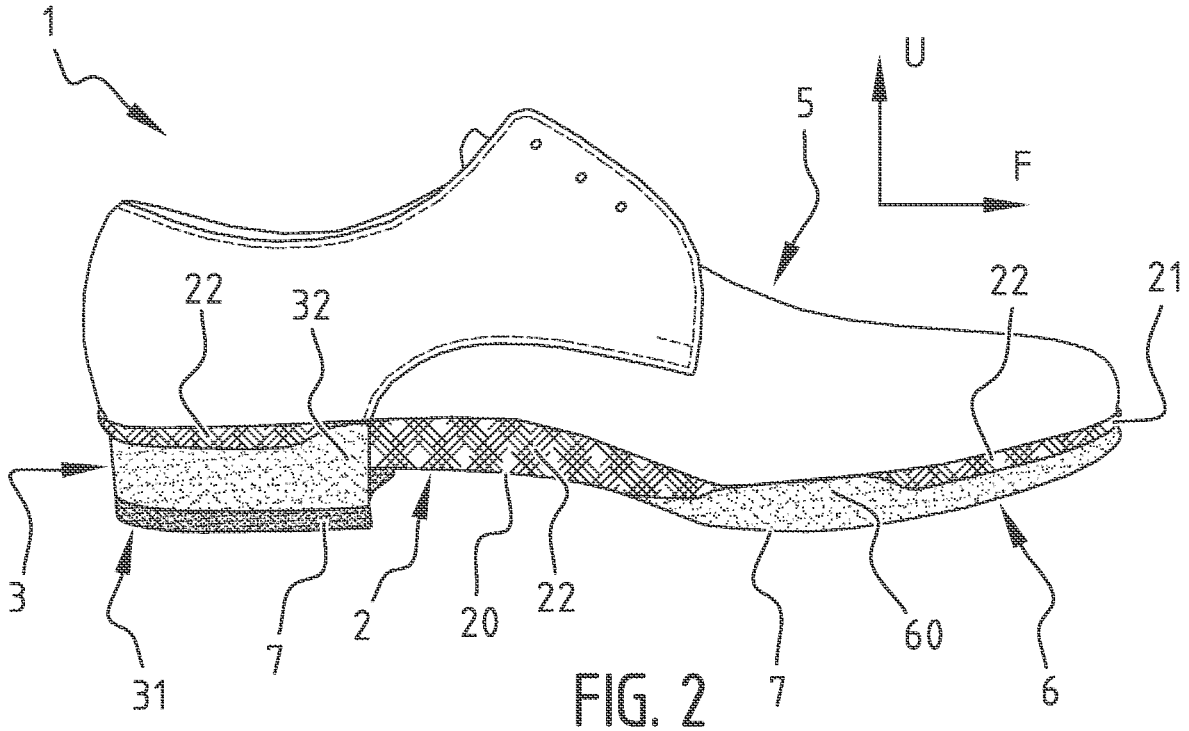
FIG. 2 shows an assembled state of a shoe according to the embodiment of FIG. 1.

FIG. 2 shows an assembled state of a shoe according to the embodiment of FIG. 1. The proportions shown in FIG. 2 are mainly for illustrative purposes, i.e. FIG. 2 is to be considered a schematic drawing. However, the proportions may naturally be chosen as desired. The upper 5 of the shoe 1 contains the inner sole 4 (not shown in FIG. 2), and is shown as the uppermost part of the shoe 1. The upper 5 is fastened to the upper side of the load-bearing outer sole 2, of which mainly the raised edge 22 remains visible. The forefoot piece 6 and heel piece 3 are fastened to the lower side of the outer sole 2, wherein surface of the recess 30 of the heel piece 3 is preferably entirely in contact with the lower surface of the outer sole 2. It is clearly visible that the transition between the hindfoot part 20 and the forefoot part 21 of the load-bearing outer sole 2 is hidden behind the ridges 60 of the forefoot piece 6. The lowermost portion of the shoe 1 consists of a wear-resistant material 7, such as rubber, which furthermore may aid in providing grip on slippery surfaces, as described above. As the load-bearing outer sole 2 is somewhat visible from the side of the shoe 1, the visible surface thereof may be coated in a lacquer or another type of decorative material as described above. The load-bearing outer sole 2 may be, for instance for decorative or structural purposes, extended over part of the upper 5. For instance, the outer sole 2 may cover part of the toe in order to provide a 'cap toe' style, or may form, for instance, a 'monk strap' or another type of fastener for fastening shoes. The outer sole 2 may extend in narrow resilient strips towards the traditional shoe lace-location (see for instance FIG. 3), so as to form an alternative to shoe laces or 'monk straps', for instance by using hook fasteners at the ends of the strips or by using the inherent resilience of the resilient strips. As shown, the outer sole 2 is slightly downwardly arched so as to effectively bridge a gap between the heel piece 3 and the forefoot piece 6 (or in another embodiment, between the heel piece 3 and the ground and/or a wear-resistant material 7). This downward arch in turn provides additional rigidity and follows the natural arch of the human foot. The outer sole 2 may also arch slightly upward near the forefoot section of the shoe sole assembly 1, for visual appearance and/or prevention of sliding of the foot of a user on the shoe sole assembly 1.

Figure 3:
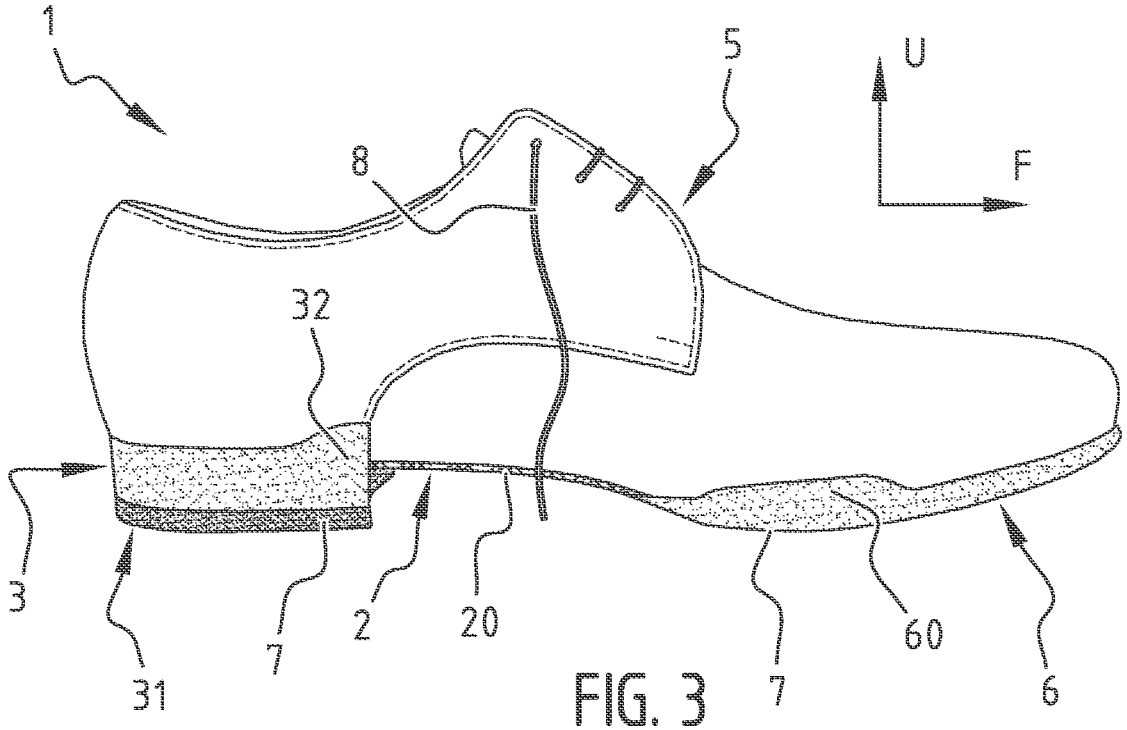
FIG. 3 shows a further embodiment of an assembled shoe.

FIG. 3 depicts another preferred embodiment according to the invention. The main differentiating feature in comparison with the embodiment of FIG. 2 is that the raised edge of the load-bearing outer sole 2 is trimmed, so as to be less visible as seen from the side of the shoe 1. Accordingly, the shoe's 1 exterior appearance closely corresponds to the exterior appearance of a traditional dress shoe. As mentioned above, the upper 5 may comprise a multitude of functional and non-functional features, such as shoelaces 8.

The invention is not limited to the shown embodiments of the shoe and shoe sole assembly, but also extends to other preferred variants thereof falling within the scope of the appended claims.

The invention claimed is:

1. A shoe sole assembly having a hindfoot section and a forefoot section, comprising:

an inner sole, comprising a shock absorbing material;

a load-bearing outer sole configured to receive the inner sole; and a heel piece, comprising a recess configured to receive at least part of the hindfoot section of the load-bearing outer sole, wherein the recess is upwardly open and is open towards the forefoot section;

wherein a thickness of the inner sole substantially corresponds to a depth of the recess, such that the inner sole substantially fills the recess.

2. The shoe sole assembly according to claim 1, further comprising a forefoot piece, comprising a forefoot recess configured to receive at least part of the forefoot section of the load-bearing outer sole, wherein the recess is upwardly open and open towards the hindfoot section.

3. The shoe sole assembly according to claim 1, wherein the load-bearing outer sole consists of a plastic, a fiber reinforced plastic, an aramid reinforced plastic, a carbon fiber reinforced plastic, a metal reinforced plastic, a metal, or a wood.

4. The shoe sole assembly according to claim 1, wherein the load-bearing outer sole is coated with a metal, a plastic, a fabric, a mineral, a mineral crystal, an organic material, a lacquer, a varnish, or combinations thereof.

5. The shoe sole assembly according to claim 1, wherein the recess is substantially concave.

6. The shoe sole assembly according to claim 1, wherein the load-bearing outer sole comprises a raised edge along its circumference.

7. The shoe sole assembly according to claim 1, wherein the load-bearing outer sole comprises a separate load-bearing hindfoot outer sole and a separate load-bearing forefoot outer sole, so as to allow bending of the shoe sole assembly between the hindfoot part and the forefoot part.

8. The shoe sole assembly according to claim 7, wherein the load-bearing hindfoot outer sole and the load-bearing forefoot outer sole are connected by a flexible material.

9. The shoe sole assembly according to claim 1, wherein the heel piece and/or the forefoot section of the load-bearing outer sole comprise a wear-resistant bottom sole on the underside thereof.

10. A shoe, comprising an upper and the shoe sole assembly according to claim 1, wherein the upper is attached to the shoe sole assembly.

11. The shoe according to claim 10, wherein the load-bearing outer sole extends over at least a portion of the upper.

12. A method of manufacturing a shoe according to claim 10, comprising:

forming the load-bearing outer sole based on a lower side of a last;

fastening part of the hindfoot section of the load-bearing outer sole to the heel piece, which has a recess which is upwardly open and open towards the forefoot section; and fastening the upper to the upper surface of the load-bearing outer sole.

13. The method according to claim 12, further comprising placing or fastening the inner sole to the upper.

14. The method according to claim 12, wherein at least one of the fastening steps comprises fastening with an adhesive.

* * * * *